US008474430B2

(12) United States Patent
Sakuyama et al.

(10) Patent No.: US 8,474,430 B2
(45) Date of Patent: Jul. 2, 2013

(54) CRANKSHAFT MECHANISM FOR ENGINE

(75) Inventors: Hisashi Sakuyama, Saitama (JP); Shunsuke Muroi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 542 days.

(21) Appl. No.: 12/390,215

(22) Filed: Feb. 20, 2009

(65) Prior Publication Data

US 2009/0211551 A1 Aug. 27, 2009

(30) Foreign Application Priority Data

Feb. 25, 2008 (JP) ..... 2008-042561

(51) Int. Cl.
*F02B 75/06* (2006.01)

(52) U.S. Cl.
USPC ..... 123/192.2; 123/197.1; 123/197.3; 123/197.4

(58) Field of Classification Search
USPC ..... 123/197.4, 197.1, 197.3, 192.2
See application file for complete search history.

(56) References Cited

U.S. PATENT DOCUMENTS

| | | | | |
|---|---|---|---|---|
| 4,641,546 | A * | 2/1987 | Mettler | 74/598 |
| 6,530,353 | B2 * | 3/2003 | Ito et al. | 123/195 R |
| 6,561,142 | B2 * | 5/2003 | Moteki et al. | 123/48 B |
| 6,763,586 | B2 * | 7/2004 | Schliemann et al. | 29/888.08 |
| 7,178,501 | B2 * | 2/2007 | Schmidt et al. | 123/197.1 |
| 7,217,035 | B2 * | 5/2007 | Damour | 384/429 |
| 7,343,893 | B2 * | 3/2008 | Suzuki et al. | 123/197.4 |
| 7,584,738 | B2 * | 9/2009 | Stott et al. | 123/197.4 |
| 7,743,746 | B2 * | 6/2010 | Maier et al. | 123/197.4 |
| 2004/0094113 | A1 * | 5/2004 | Honda et al. | 123/196 R |
| 2006/0150944 | A1 * | 7/2006 | Stott et al. | 123/197.4 |
| 2007/0204829 | A1 * | 9/2007 | Takahashi et al. | 123/197.4 |

FOREIGN PATENT DOCUMENTS

| | | | |
|---|---|---|---|
| JP | 2002-174131 | A | 6/2002 |
| JP | 2002-065151 | A | 5/2003 |

* cited by examiner

*Primary Examiner* — Noah Kamen
*Assistant Examiner* — Grant Moubry
(74) *Attorney, Agent, or Firm* — Birch, Stewart, Kolasch & Birch, LLP

(57) ABSTRACT

A crankshaft mechanism for an engine wherein a crankshaft can be disposed close to the piston side while securing a moment of inertia. In the crankshaft mechanism for the engine including the piston, the crankshaft is provided with a crank pin and counterweight parts, and a connecting rod connecting the piston and the crank pin of the crankshaft to each other, the inner side of a circumferential end, on the opposite side of the crank pin, of each of the counterweight parts is cut out along a curve at equidistance R from the center Q of the crank pin, to obtain such a shape so as to avoid a projected part, projected in the direction of the piston, at the lower end of a small end part of the connecting rod when the piston reaches the bottom dead center.

20 Claims, 6 Drawing Sheets

CRANKSHAFT MECHANISM FOR ENGINE

CROSS-REFERENCE TO RELATED APPLICATIONS

The present application claims priority under 35 USC 119 to Japanese Patent Application No. 2008-042561 filed on Feb. 25, 2008 the entire contents of which are hereby incorporated by reference.

FIELD OF THE INVENTION

The present invention relates to a crankshaft mechanism for an engine connected to a piston through a connecting rod.

DESCRIPTION OF BACKGROUND ART

A reciprocation-type internal combustion engine is known wherein a rectilinear motion of a piston is converted into a rotational motion of a crankshaft through a swingable connecting rod to obtain a rotational motive power has been known. The crankshaft includes a crank journal rotatably supported on the engine, a crank pin connected to the connecting rod, and a crank arm connecting the crank journal and the crank pin to each other in an eccentric state. The crank arm is provided with a counterweight part at a position on the opposite side of the crank pin with reference to a rotary shaft of the crank journal, so as to take a rotational balance with the reciprocating motion of the piston and the swinging motion of the connecting rod. An outer edge part of the counterweight part is formed in the shape of a circular arc with the crank journal as a center, so as to most approach a lower end part of the piston when the piston reaches the bottom dead center based on the rotation of the crank journal.

In recent years, the height size of an engine has been reduced as much as possible, so as to contrive a lowering of the center of gravity of the vehicle body. For this purpose, it is desirable to minimize the gap between the piston and the counterweight part when the piston reaches the bottom dead center. Hitherto, there has been disclosed a technology wherein, for securing the just-mentioned gap, that portion of an arc-shaped outer edge part of the counterweight part which becomes the nearest to the piston when the piston reaches the bottom dead center is cut out so as to dispose the crankshaft as close to the piston side as possible. See, for example, Japanese Patent Laid-open No. 2002-174131.

However, the counterweight part is for attaining a rotational balance by utilizing a moment of inertia (centrifugal force). Therefore, it is undesirable to cut out an outer edge part which is the most effective for obtaining the moment of inertia.

SUMMARY AND OBJECTS OF THE INVENTION

It is an object of an embodiment of the present invention to provide a crankshaft mechanism for an engine with which it is possible to dispose a crankshaft close to the piston side while securing a moment of inertia.

In order to solve the above-mentioned problem, according to an embodiment of the present invention, there is provided a crankshaft mechanism for an engine including a piston, a crankshaft provided with a crank pin and a counterweight part, and a connecting rod connecting the piston and the crank pin of the crankshaft to each other. The inner side of a circumferential end, on the opposite side of the crank pin, of the counterweight part is cut out along a curve at equidistance from the center of the crank pin to obtain such a shape as to avoid a projected part, projected in the direction of a piston pin, at a lower end of a small end part of the connecting rod when the piston reaches a bottom dead center.

According to this configuration, an outer edge part in the radial direction of the counterweight part is not cut out, and, therefore, an inertial force can be obtained effectively.

In the crankshaft mechanism for an engine according to an embodiment of the present invention, the inner side of a circumferential end, on the opposite side of the crank pin, of each counterweight is cut out along a curve at equidistance from the center of the crank pin to obtain such a shape as to avoid a projected part, projected in the direction of a piston pin, at the lower end of the small end part of the connecting rod when the piston reaches the bottom dead center. Therefore, the crankshaft can be disposed close to the lower end of the piston while securing the moment of inertia necessary for the counterweight parts of the crank arms. As a result, the crankshaft can be disposed close to the piston side, so that the size of the engine in the height direction can be reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
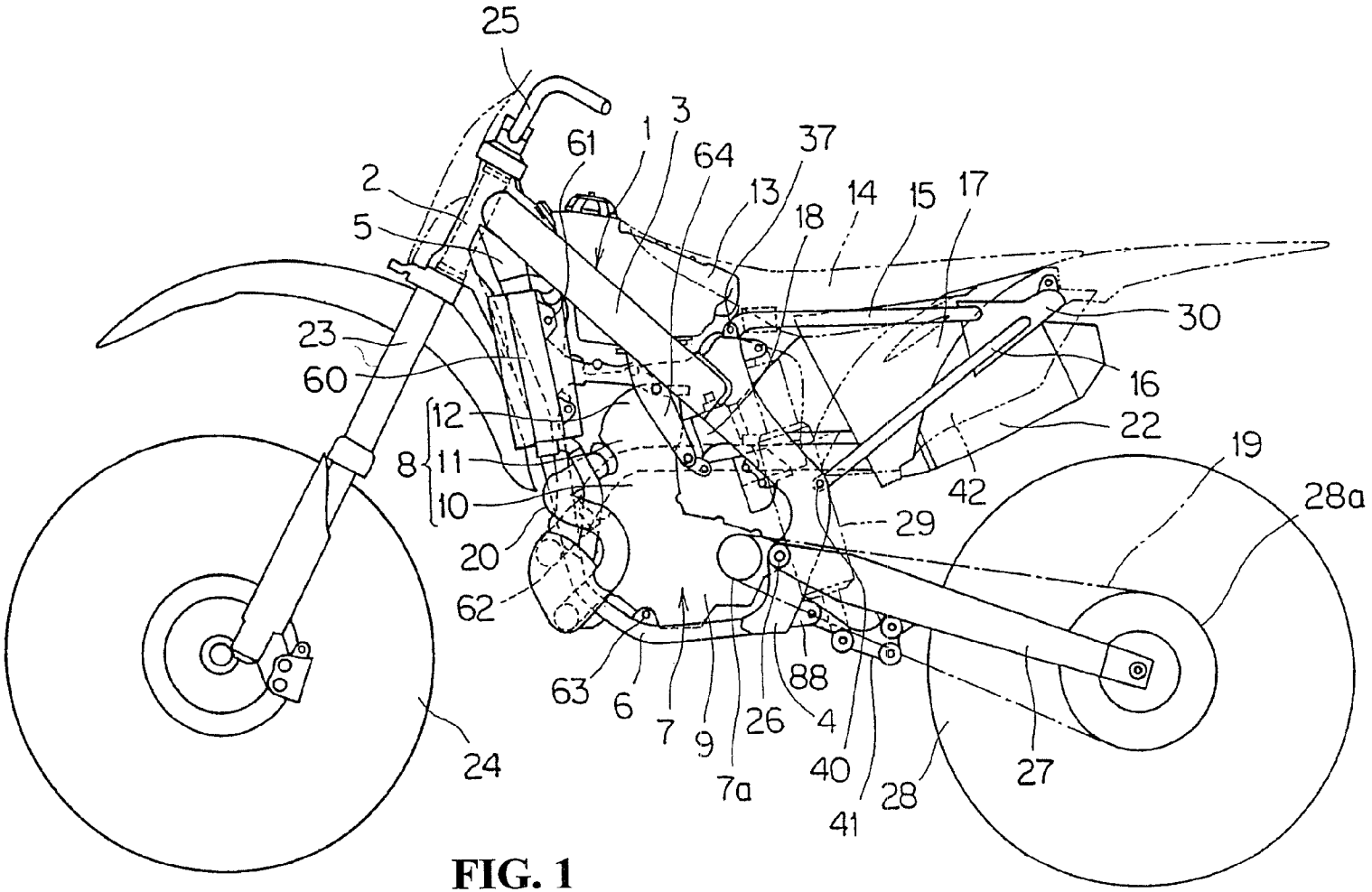
FIG. 1 is a side view of a motorcycle in one embodiment of the present invention.

FIG. 1 is a side view of an off-road type motorcycle pertaining to an embodiment of the present invention.

A body frame 1 of the motorcycle includes a head pipe 2, main frames 3, center frames 4, a down frame 5 and lower frames 6, which are connected in a looped form, with an engine 7 supported on the inside thereof. The engine 7 includes a cylinder 8 and a crankcase 9. The main frames 3, the center frames 4 and the lower frames 6 are provided in left-right pairs, whereas the head pipe 2 and the down frame 5 are provided as single members along the center of the vehicle body.

The main frame 3 extends rearwardly downwards in a rectilinear form on the upper side of the engine 7, and is connected to an upper end part of the center frame 4, which extends vertically on the rear side of the engine 7. The down frame 5 extends skewly downwards on the front side of the engine 7, and is connected to a front end part of the lower frame 6 at its lower end part. The lower frame 6 is bent from a front-side lower part of the engine 7 toward the lower side of the engine 7, extends substantially rectilinearly to the rear, and is connected to a lower end part of the center frame 4 at its rear end part.

The engine 7 is a water-cooled 4-cycle engine, the cylinder o is provided at a front part of the crankcase 9 in an upright state with its cylinder axis substantially vertical, and includes a cylinder block 10, a cylinder head 11, and a head cover 12 in this order from the lower side toward the upper side. With the cylinder 8 set upright, the size of the engine 7 in the front-rear direction is made to be small, whereby the configuration of the engine 7 is rendered suitable for an off-road vehicle.

A fuel tank 13 is disposed on the upper side of the engine 7, and is supported on the main frames 3. An incorporated type fuel pump (see FIG. 6) is contained in the inside of the fuel tank 13. Fuel at a high pressure is supplied from the fuel pump to a throttle body 18 through a fuel supply pipe.

A seat 14 is disposed on the rear side of the fuel tank 13, and is supported on seat rails 15 extending to the rear from the upper ends of the center frames 4. Rear frames 16 are disposed on the lower side of the seat frames 15. An air cleaner 17 is supported on the seat frames 15 and the rear frames 16, and air is taken in from the rear side of the vehicle body into the cylinder head 1 1 through the throttle body 18.

An exhaust pipe 20 is provided at a front part of the cylinder 8. The exhaust pipe 20 extends from the front part of the cylinder 8 toward the front side of the crankcase 9, is bent to the right side, and then extends on the right side of the vehicle body around toward the rear side. From the exhaust pipe 20, a muffler 22 extends to the rear. A rear end part of the muffler 22 is supported by the rear frames 16.

A front fork 23 is supported on the head pipe 2. A front wheel 24 is supported by lower end parts of the front fork 23 and is steered by a steering handle 25. Front end parts of rear arms 27 are swingably supported on the center frames 4 through a pivot shaft 26. A rear wheel 28 is supported on rear end parts of the rear arms 27, and is driven by a drive chain 19 wrapped around a drive sprocket 7*a* of the engine 7 and a driven sprocket 28*a* on the rear wheel 28. Rear shock absorbers 29 of a rear suspension are provided between the rear arms 27 and rear end parts of the center frames 4.

In addition, in FIG. 1, a radiator 60, a rubber mount part 61 thereof, 62 engine mount parts 62 and 63, and an engine hanger 64 are provided. In addition, the engine 7 is supported on the center frames 4 also through the pivot shaft 26.

Figure 2:
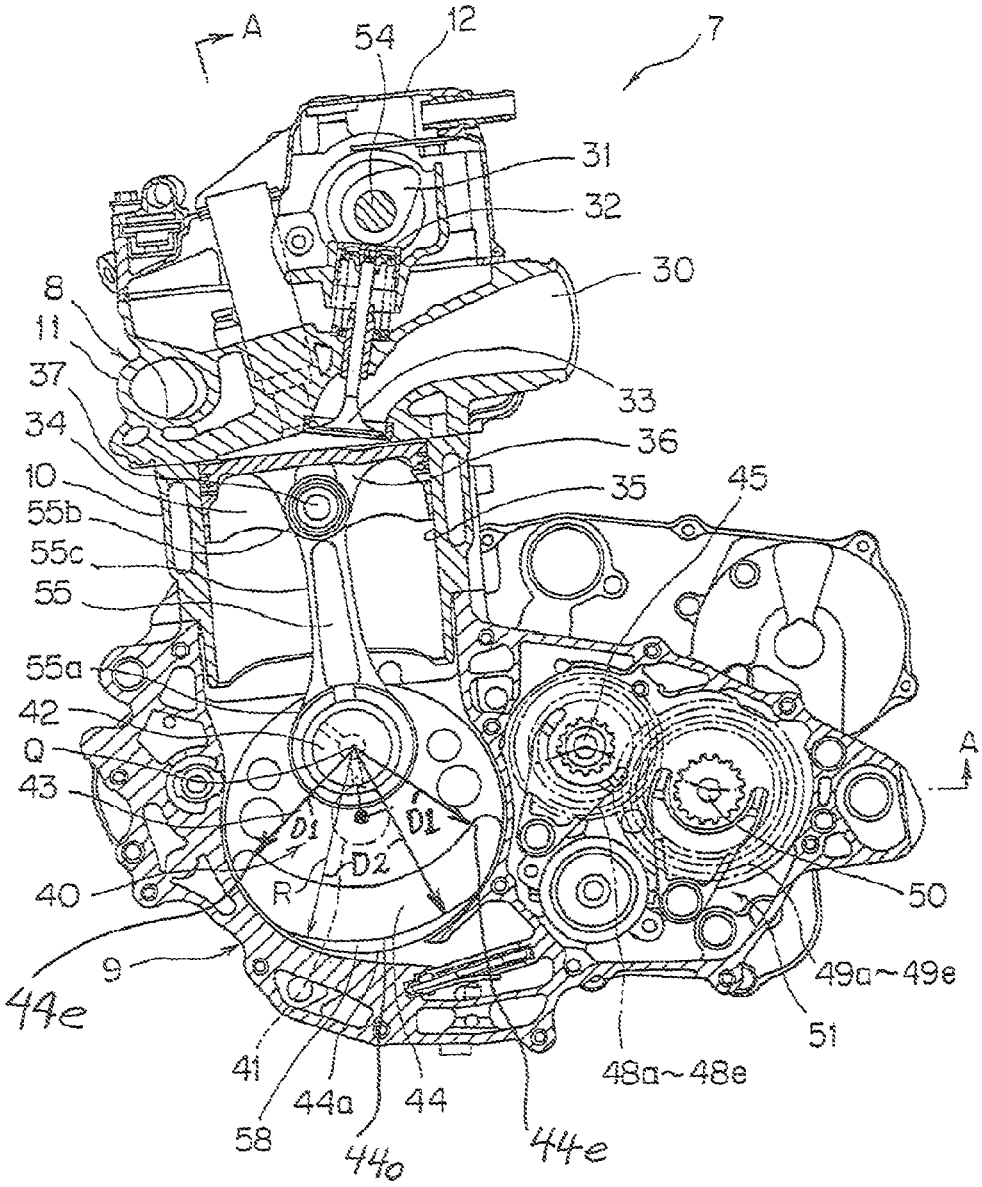
FIG. 2 is a side sectional view of a water-cooled 4-cycle single-cylinder engine.
Figure 3:
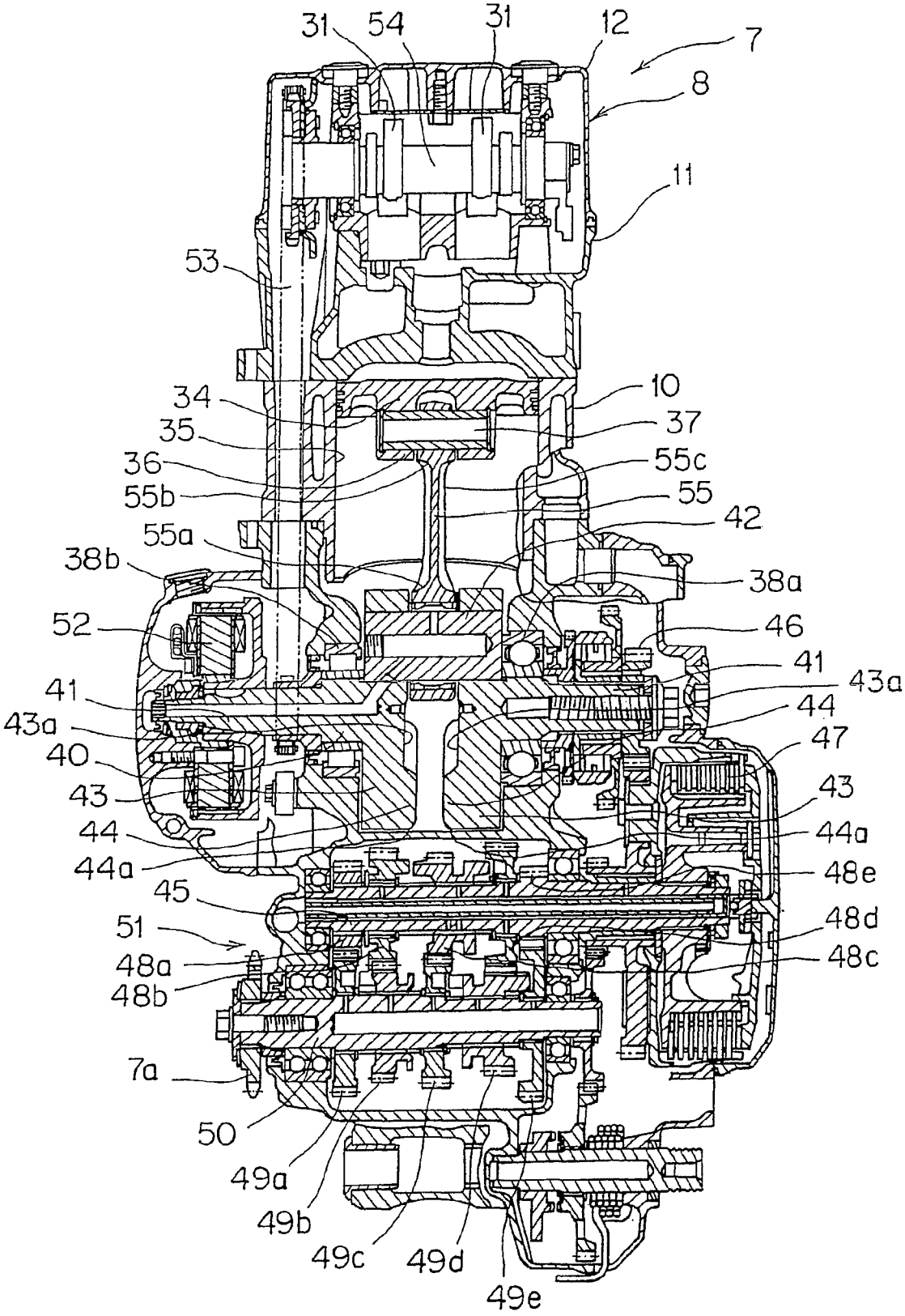
FIG. 3 is a sectional view taken along line A-A of FIG. 2.

FIG. 2 is a side sectional view of the water-cooled 4-cycle single-cylinder engine 7, and FIG. 3 is a front view which corresponds to FIG. 2 and which is a sectional view taken along line A-A.

As mentioned above, the engine 7 includes the cylinder 8 (the cylinder block 10, the cylinder head 11, and the head cover 12) and the crankcase 9.

On the vehicle body rear side of the cylinder head 11, there is provided an intake port 30 through which a fuel-air mixture from the throttle body 18 is supplied into the engine 7. The intake port 30 is opened and closed through an intake valve 33 moved up and down by a cam 31 and a valve lifter 32 which are provided inside the head cover 12, whereby the fuel-air mixture is supplied into a combustion chamber S (see FIG. 5). Similarly, an exhaust port (not shown) is provided on the vehicle body front side of the cylinder head 11, and the fuel-air mixture combusted in the combustion chamber S is exhausted therethrough.

The cylinder block 10 is provided with a cylinder part 35 in which a piston 34 can be reciprocated in a vertical direction (more accurately, in a direction slightly inclined to a forwardly upward side).

On the other hand, as shown in FIG. 2, a crankshaft 40 located on the lower side of the piston 34, a main shaft 45 located on the vehicle body rear side relative to the crankshaft 40, and a drive shaft 50 located further on the vehicle body rear side relative to the main shaft 45 are provided in the crankcase 9. The axes of rotation of the crankshaft 40, the main shaft 45, and the drive shaft are disposed in parallel to each other, and power is transmitted among the shafts through gears which will be described later.

As shown in FIG. 3, the crankshaft 40 includes crank journals 41 on both the left and right sides which are rotatably supported on a crankcase body, a crank pin 42 located eccentrically in relation to the crank journals 41, and a left-right pair of crank arms 43 connecting the crank journals 41 to the crank pin 42. The crank journal 41 and the crank arm 43 are formed integrally, as shown in FIG. 3.

As shown in FIG. 3, the crank journals 41 at both ends are rotatably supported by bearings 38*a*, 38*b*.

One end part 55*a* of the connecting rod 55 (hereinafter referred to as the big end part 55*a*) is turnably attached to the crank pin 42. On the other hand, the other end 55*b* of the connecting rod 55 (hereinafter referred to as the small end part 55*b*) is turnably attached to a boss part 36, which is located at the lower end of the piston 34, through a piston pin 37.

As shown in FIG. 2, the connecting rod 55 extends vertically to constitute an arm of a link mechanism, and, when the piston 34 is moved up and down, the crank pin 42 is rotated about the axis of rotation of the crank journals 41, to give rotational power to the crankshaft 40.

As shown in FIG. 2, the crank arms 43 are each formed in a true circular shape in side view. In addition, the crank arm 43 is provided with a cresent-shaped counterweight part 44 only at a position on the opposite side of the crank pin 42 with reference to the axis of rotation of the crank journal 41. The cresent-shaped counterweight parts 44 are respectively formed integrally with the left and right crank arms 43 in the state of projecting to the further inner side from inside surfaces 43*a* of the crank arms 43, and are each formed in a crescent shape in side view, as shown in FIG. 2. Each of the cresent-shaped counterweight parts 44 is formed only on a portion of the inner surface of the crank arm 43 opposite to where the crank pin 42 is located, and an inner side of a circumferential end 44 *e* of each of the cresent-shaped counterweight parts 44 is cut out along a curve at an equidistance D1 from a center Q of said crank pin 42. An arc-shaped outside edge part 44*a* of the crescent shape coincides with the outer circumferential edge part of the crank arm 43.

In addition, a primary reduction gear 46 rotated together with the crankshaft 40 is provided at a vehicle body right side part of the crankshaft 40. The primary reduction gear 46 is meshed with a housing gear 47*a* of a multiple-disk clutch 47 disposed on the main shaft 45. As a result, the rotational power of the crankshaft 40 is transmitted through the primary reduction gear 46 and the multiple-disk clutch 47 to the main shaft 45.

A plurality of speed change gears are provided on the main shaft 45 and the drive shaft 50, to constitute a transmission mechanism 51. More specifically, first to fifth change gears 48*a* to 48*e* are provided on the main shaft 45, and first to fifth change gears 49*a* to 49*e* corresponding to and meshed with the change gears 48*a* to 48*e* are provided on the drive shaft 50. By changing over the mutual meshing of the change gears, the rotating speed of the drive shaft 50 is changed over and the rotational power is transmitted from the main shaft 45 to the drive shaft 50.

A drive sprocket 7*a* is mounted to that shaft end part on the vehicle body left side of the drive shaft 50 which protrudes to the outside of the crankcase 9. As shown in FIG. 1, the drive chain 19 is wrapped around the drive sprocket 7*a,* so as to drive the rear wheel 28.

In addition, in FIGS. 2 and 3, a generator 52 is attached to a shaft end of the crankshaft 40 with a chain 53 being provided for transmitting motive power of the crankshaft 40 to a camshaft 54.

Figure 4:
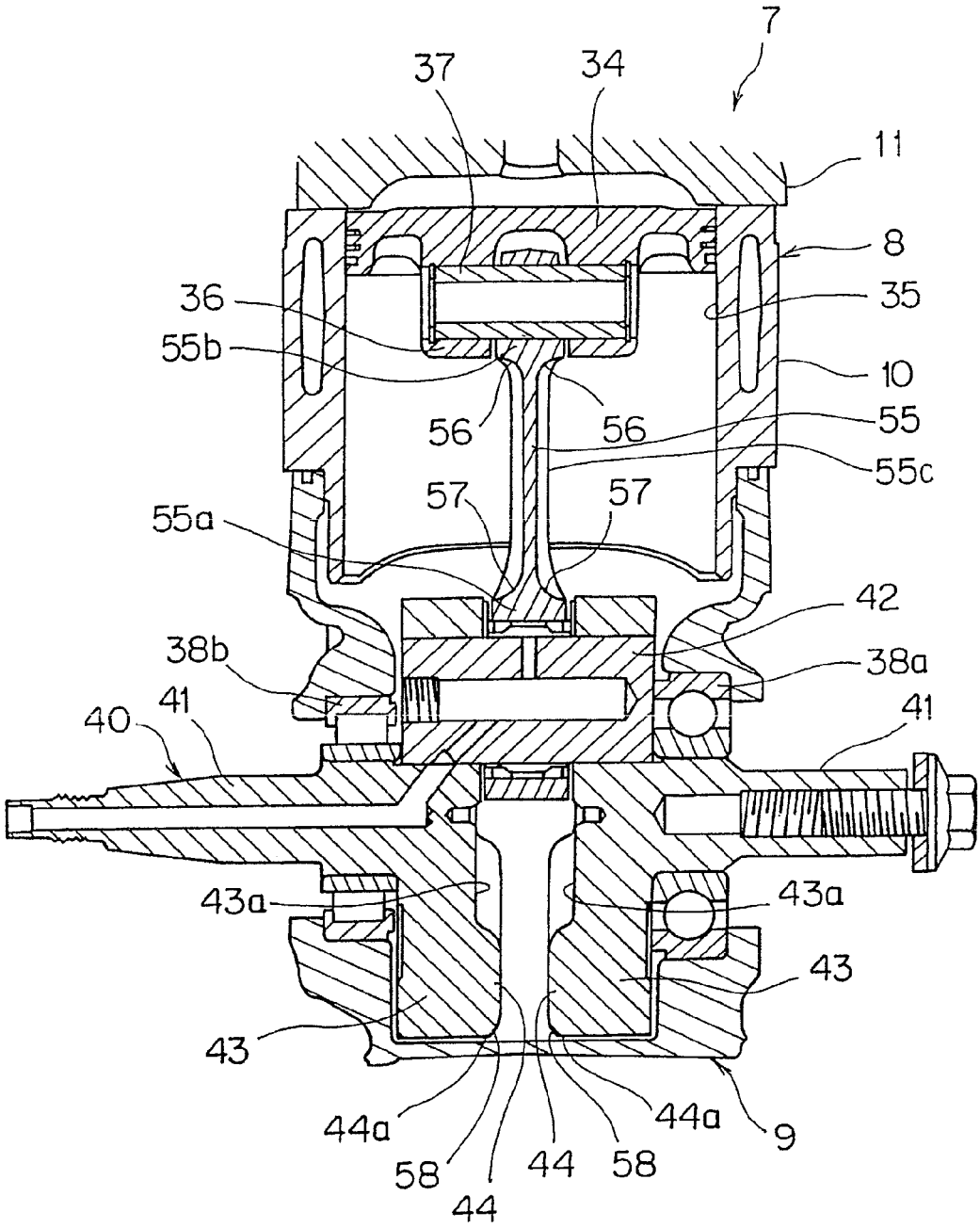
FIG. 4 is a sectional view showing the condition where a piston is located at the top dead center.
Figure 5:
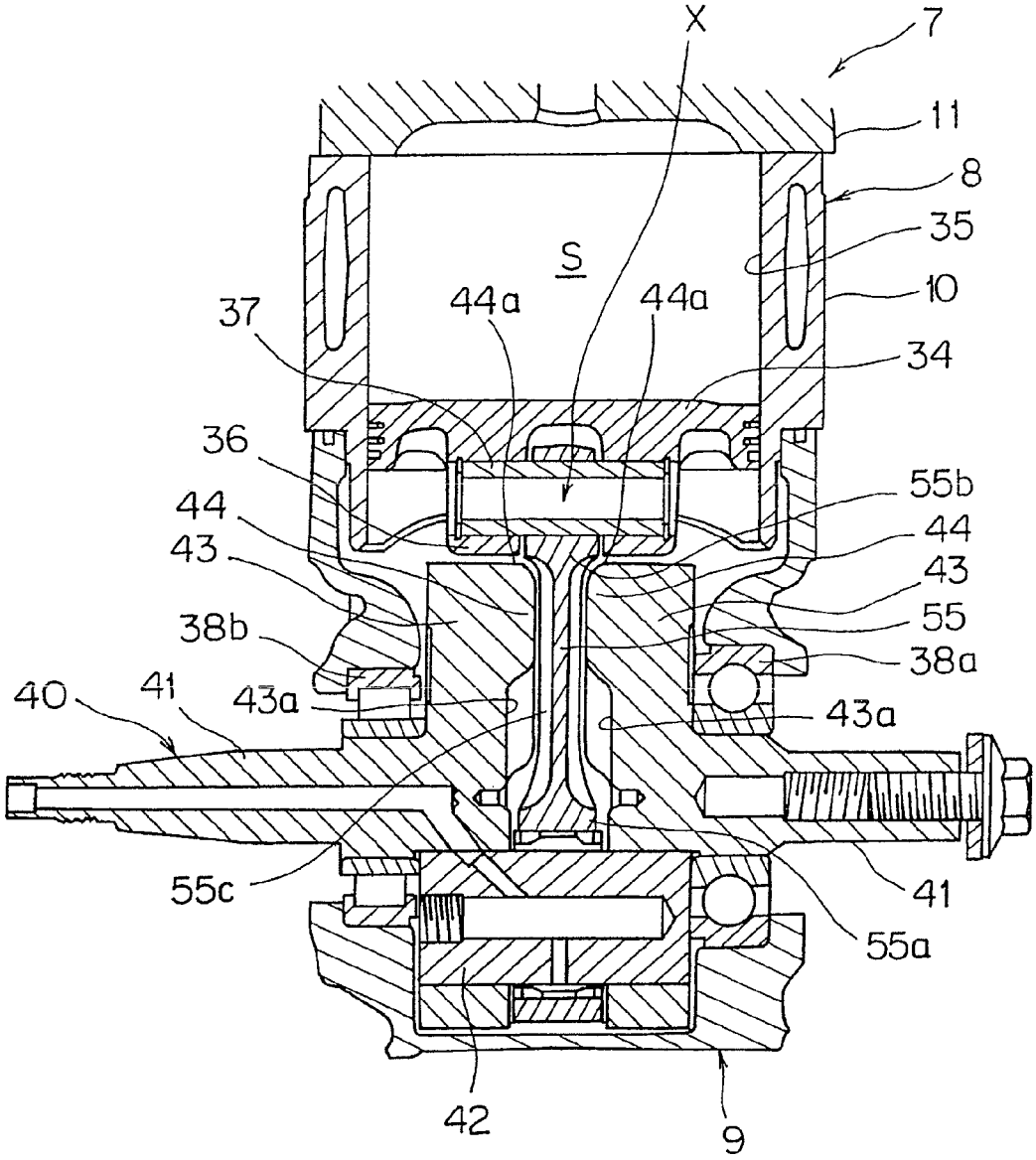
FIG. 5 is a sectional view showing the condition where the piston is located at the bottom dead center.
Figure 6:
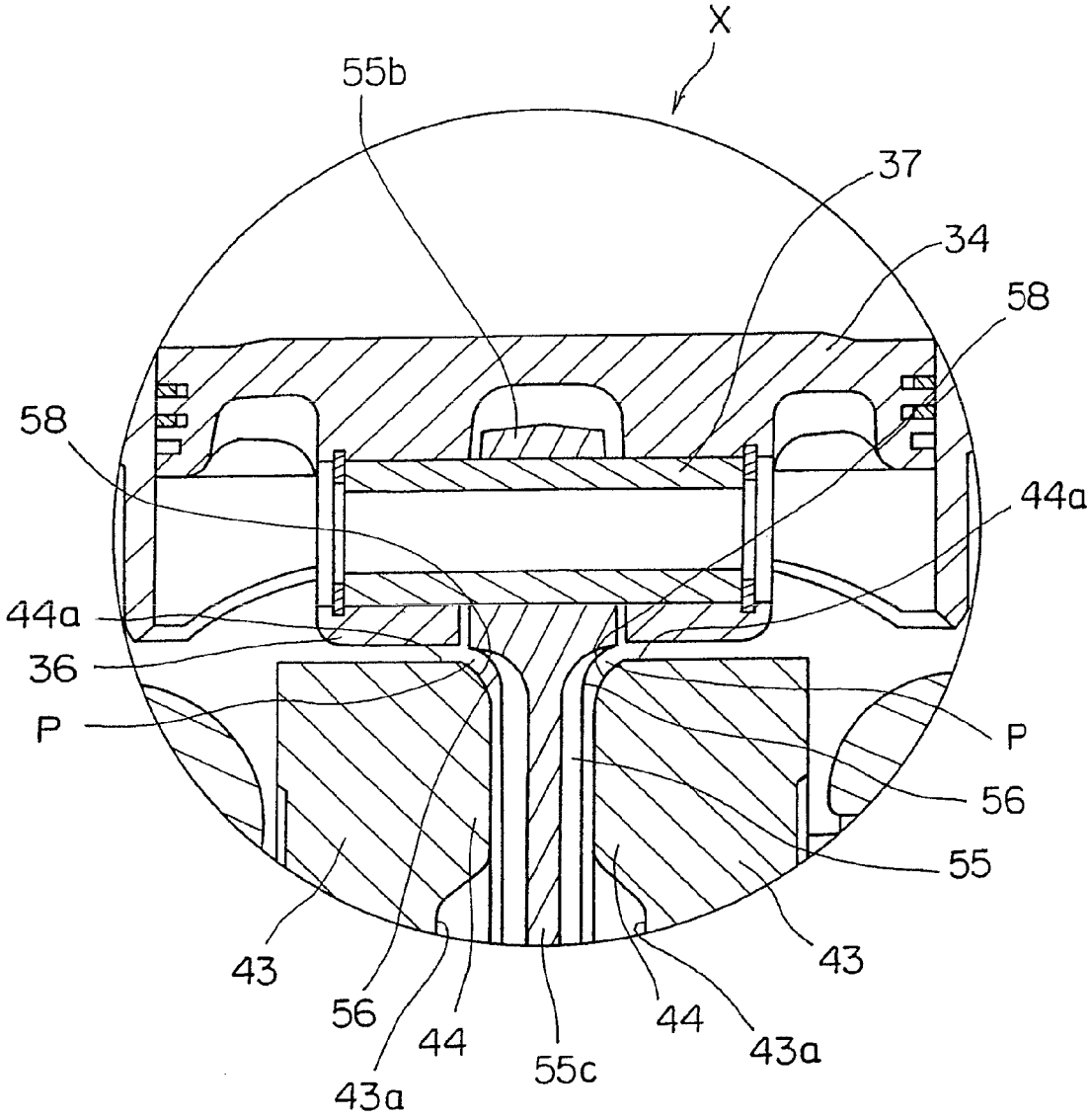
FIG. 6 is an enlarged view of part X of FIG. 5.

FIG. 4 is a sectional view showing the condition where the piston 34 is located at the top dead center. FIG. 5 is a sectional view showing the condition where the piston 34 is located at the bottom dead center. FIG. 6 is an enlarged view of part X of FIG. 5, showing the condition where the counterweight part 44 and the connecting rod 55 are close to each other.

As shown in FIGS. 4 and 5, the connecting rod 55 is formed to be large in plate thickness at the big end part 55*a* (the part for attachment to the crank pin 42) and the small end part 55*b* (the part for attachment to the piston pin 37). In addition, an arm part 55*c* connecting the big end part 55*a* and the small end part 55*b* to each other is formed to be smaller in plate thickness than the one end part 55*a* and the other end part 55*b,* and are provided in their central parts with lightenings (thinnings) from both sides, as shown in FIG. 2. When the crankshaft 40 is rotated, the connecting rod 55 is passed between the crank arms 43 and the counterweight parts 44 on both sides, as shown in FIGS. 4 and 5.

At a connection part between the small end part 55*b* and the arm part 55*c,* R-shaped parts 56 (projected part) are formed by padding (projecting) in an R shape, for the purpose of obviating stress concentration. Similarly, a connection part between the big end part 55*a* and the arm part 55*c* is also provided with R-shaped parts 57.

On the other hand, at outside edge parts 44*a* of the counterweight parts 44, more specifically at corner parts where the counterweight parts 44 on both sides are opposed to each other, R chamfer parts 58 are formed by cutting out the opposed inside surfaces.

In this embodiment, for reducing the size of the engine 7 in the height direction, as shown in FIG. 6, the component parts are disposed so as to minimize the gaps between the boss part 36 of the piston 34 and the small end part 55*b* of the connecting rod, and the outside edge part 44*a* of the counterweight parts 44 in the vertical direction. On the other hand, for avoiding interference between the connecting rod 55 and the counterweight parts 44 in the case where the gaps are set to the required minimum, the shape of the R chamfer parts 58 is determined in such a manner so as to avoid the R-shaped parts 56, projecting in the vehicle width direction (the direction in which the piston pin 37 extends), at the lower end of the small end part 55*b*.

More specifically, as shown in FIG. 2, the R chamfer part 58 is formed by cutting out, in the vehicle width direction, the portion which ranges from a circular arc (second curve) 44*o* with a radius R (securing equidistance D2) from the center Q of the crank pin 42 to the outside edge part 44*a* of the counterweight part 44. As shown in FIG. 6, the R chamfer part 58 is formed in such a shape so as to avoid interference (as to generate a gap P) between the R-shaped part 56 and the R chamfer part 58 in the vehicle width direction under the condition where the piston 34 is located at the bottom dead center.

According to the crankshaft mechanism for an engine pertaining to one embodiment of the present invention, the inner side of the circumferential end, on the opposite side of the crank pin 42, of each of the counterweight parts 44 is cut out along a curve at equidistance (the distance of radius R) from the center Q of the crank pin 42, to obtain such a shape so as to avoid the projected part 56, projected in the direction of the piston pin 37, at the lower end of the small end part 55*b* of the connecting rod 55 when the piston 34 reaches the bottom dead center. Therefore, the counterweight parts 44 can be disposed close to the lower end of the piston 34 while securing the required moment of inertia and the required unbalance weight amount at the counterweight parts 44 of the crank arms 43, without increasing the weight. As a result, the crankshaft 40 can be disposed close to the piston 34 side, so that the engine 7 can be reduced in size in the height direction. In addition, while the R-shaped parts 56 (cutouts) are formed as large R-shaped chamfers in the above-described embodiment, other cutout shapes may also be adopted, such as skew cut (so-called C chamfer).

In addition, while the counterweight parts 44 are cut out in the vehicle width direction in this embodiment, the reduction in the moment amount can be compensated for by slightly increasing the thickness in the width direction of the crank arms 43. More specifically, the method of cutting off outer edge parts of the counterweight parts 44 as in the related art is not adopted here, so that the reduction in the moment amount is slight. Therefore, the reduction in the moment amount can be compensated for by only slightly increasing the thickness of the crank arms 43, so that it is unnecessary to enlarge the engine 7 in size in the vehicle width direction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A crankshaft mechanism for an engine comprising:

a piston;

a crankshaft having a left part and a right part, each of the left and right parts being provided with a circular-shaped crank arm having a crescent-shaped counterweight part integrally formed on an inner surface thereof;

a crank pin bridging between the circular-shaped crank arm of each of the left and right parts; and a connecting rod connecting said piston and the crank pin to each other with one of said counterweight parts being disposed on each side of the connecting rod;

wherein each of the crescent-shaped counterweight parts is formed only on a portion of the inner surface of the crank arm opposite to where the crank pin is located, and an inner side of a circumferential end (44*e*) of each of the crescent-shaped counterweight parts is cut out along a curve at an equidistance (D1) from a center (Q) of said crank pin to obtain a shape on the inner side of the circumferential end of each of the crescent-shaped counterweight parts to avoid a projected part, projecting in a direction of a piston pin, from each side at a lower end of a small end part of said connecting rod when said piston reaches a bottom dead center.

2. The crankshaft mechanism for an engine according to claim 1, wherein each of the crescent-shaped counterweight parts includes edge parts that are convex-shaped chamfer parts formed by cutting out opposed inside surfaces for accommodating the projected parts.

3. The crankshaft mechanism for an engine according to claim 2, wherein in addition to the small end part, the connecting rod also includes a big end part, and both of the small end part and the big end part include the projected parts that are accommodated by the convex-shaped chamfer parts of the counterweight parts when either the big end part or the small end part reach the bottom dead center.

4. The crankshaft mechanism for an engine according to claim 3, wherein the big end part and the small end part are formed to be larger in plate thickness relative to the connecting rod formed to be smaller in plate thickness.

5. The crankshaft mechanism for an engine according to claim 1, wherein when the left and right parts of the crankshaft are rotated, the connecting rod passes between the crank arm and the counterweight part disposed on each side of the connecting rod.

6. The crankshaft mechanism for an engine according to claim 1 wherein each of the projected parts is padded for obviating stress concentration between the small end part and the connecting rod.

7. The crankshaft mechanism for an engine according to claim 1, wherein each of the crescent-shaped counterweight parts is formed in a predetermined region of the corresponding crank arm for avoiding interference between the counterweight parts and the projected parts.

8. The crankshaft mechanism for an engine according to claim 7, wherein each of the crescent-shaped counterweight parts is cut out along a second curve (44*o*) at a second equidistance (D2) from the center (Q) of the crank pin for positioning the crescent-shaped counterweight parts to be disposed in close proximity to a lower end of the piston while providing a predetermined moment of inertia and a predetermined unbalanced weight amount at the counterweight part of each of the crank arms without increasing a weight of the counterweight part.

9. The crankshaft mechanism for an engine according to claim 8, wherein each of the left and right parts of the crankshaft is disposed close to a side of the piston for reducing a size and height dimension of the engine.

10. The crankshaft mechanism for an engine according to claim 9, wherein each of the crescent-shaped counterweight parts is cut out in a vehicle width direction, wherein a reduction in a moment amount is compensated for by slightly increasing a thickness in a width direction of each of the crank arms.

11. A crankshaft mechanism for an engine comprising:

a piston;

a crankshaft having a first part and a second part, each of the first and second parts being provided with a circular-shaped crank arm having a crescent-shaped counterweight part integrally formed on an inner surface thereof;

a crank pin bridging between the first and second parts of the crankshaft;

a connecting rod connecting said piston and said crank pin to each other with one of the counterweight parts formed on each side of the connecting rod, wherein each of the crescent-shaped counterweight parts is formed only on a portion of the inner surface of the crank arm opposite to where the crank pin is located, each counterweight part including an inner side of a circumferential end (44*e*) that is cut out along a curve at an equidistance (D1) from a center (Q) of said crank pin;

said cut out shape on the inner side of each of said counterweight parts avoids a projected part from each side at a lower end of a small end part of said connecting rod when said piston reaches a bottom dead center.

12. The crankshaft mechanism for an engine according to claim 11, wherein each of the crescent-shaped counterweight parts includes edge parts that are convex-shaped chamfer parts formed by cutting out opposed inside surfaces for accommodating the projected parts.

13. The crankshaft mechanism for an engine according to claim 12, wherein in addition to the small end part, the connecting rod also includes a big end part, and both of the small end part and the big end part include the projected parts that are accommodated by the convex-shaped chamfer parts of the counterweight parts when either the big end part or the small end part reach the bottom dead center.

14. The crankshaft mechanism for an engine according to claim 13, wherein the big end part and the small end part are formed to be larger in plate thickness relative to the connecting rod formed to be smaller in plate thickness.

15. The crankshaft mechanism for an engine according to claim 11, wherein when each of the first and second parts of the crankshaft is rotated, the connecting rod passes between the crank arm and the counterweight part disposed on each side of the connecting rod.

16. The crankshaft mechanism for an engine according to claim 11, wherein each of the projected parts is padded for obviating stress concentration between the small end part and the connecting rod.

17. The crankshaft mechanism for an engine according to claim 12, in order to ensure that the crankshaft mechanism has an effective the moment of inertia, the convex-shaped chamfer parts formed only on opposed inside surfaces of the counterweight parts.

18. The crankshaft mechanism for an engine according to claim 11, wherein each of the crescent-shaped counterweight parts is cut out along a second curve (44*o*) at a second equidistance (D2) from the center (Q) of the crank pin for positioning the crescent-shaped counterweight parts to be disposed in close proximity to a lower end of the piston while providing a predetermined moment of inertia and a predetermined unbalanced weight amount at the counterweight part of each of the crank arms without increasing a weight of the counterweight.

19. The crankshaft mechanism for an engine according to claim 18, wherein each of the first and second parts of the crankshaft is disposed close to a side of the piston for reducing a size and height dimension of the engine.

20. The crankshaft mechanism for an engine according to claim 19, wherein each of the counterweight parts is cut out in a vehicle width direction, wherein a reduction in a moment amount is compensated for by slightly increasing a thickness in a width direction of each of the crank arms.

* * * * *